US005183154A

United States Patent [19]

Slemp

[11] Patent Number: 5,183,154

[45] Date of Patent: Feb. 2, 1993

[54] GOLF BALL HOLDER DISPENSER

[76] Inventor: Mark C. Slemp, R.R. 1, Box 125, Alton, Iowa 51003

[21] Appl. No.: 825,595

[22] Filed: Jan. 24, 1992

[51] Int. Cl.[5] ..... B65D 85/58

[52] U.S. Cl. ..... 206/315.9; 221/307; 224/919

[58] Field of Search ..... 206/315.9; 221/303, 221/307, 308, 309, 310, 312 A, 312 B, 312 C; 224/918, 919

[56] References Cited

U.S. PATENT DOCUMENTS

| | | | |
|---|---|---|---|
| 2,768,775 | 10/1956 | Houser | 224/5 |
| 3,756,299 | 9/1973 | Simmons et al. | 206/315.9 |
| 4,082,209 | 4/1978 | Sanders | 224/29 |
| 4,610,373 | 9/1986 | Sherbondy | 221/155 |
| 4,678,108 | 7/1987 | Inman | 224/274 |
| 4,798,319 | 1/1989 | James, Jr. | 224/919 |
| 4,850,483 | 7/1989 | Stack | 206/315.9 |
| 4,927,052 | 5/1990 | Marthaler et al. | 221/64 |
| 4,955,529 | 9/1990 | Barnhart | 206/315.9 |
| 5,040,675 | 8/1991 | Cleveland et al. | 206/315.9 |

*Primary Examiner*—Jimmy G. Foster

[57] ABSTRACT

A golf ball holder which is simplified so that no auxiliary springs, gates or the like are necessary to hold the balls in place, and so that simple manipulation of the ball makes insertion and ejection possible. The device uses the deformability of the material at the ball opening to detain the ball. An opening opposite the ball opening provides access so the ball can be pushed from the holder.

3 Claims, 1 Drawing Sheet

GOLF BALL HOLDER DISPENSER

BACKGROUND AND SUMMARY OF THE INVENTION

This invention pertains to holders for golf balls and more particularly to a small holder for a limited number of balls which is easy to use and of simplified construction.

Most golfers do not have the luxury of having a caddy to carry clubs, balls and other accoutrements of the game. Thus, most golfers find it necessary to carry a plurality of balls. Pockets on the golf bag are usually available, but not always convenient particularly when the bag is carried on a cart. Golfers who wear trousers with adequate pockets can conveniently carry two or three extra balls in a trouser pocket. But even that expedient is not universally available.

In view of the need, certain types of carriers have been proposed. These are generally tubular holders for two to six balls. The variation is principally in the mode of holding the balls in place to avoid accidental ejection and still allowing easy volitional ejection when desired. Most prior holders use some sort of spring finger or elasticized opening to accomplish the holding.

By my invention, I use the shape of the opening and the flexure of the material of the tube to hold the balls in place and to allow ready ejection by pressing the ball from a smaller opening opposite the ejection exit.

DESCRIPTION

Figure 2:
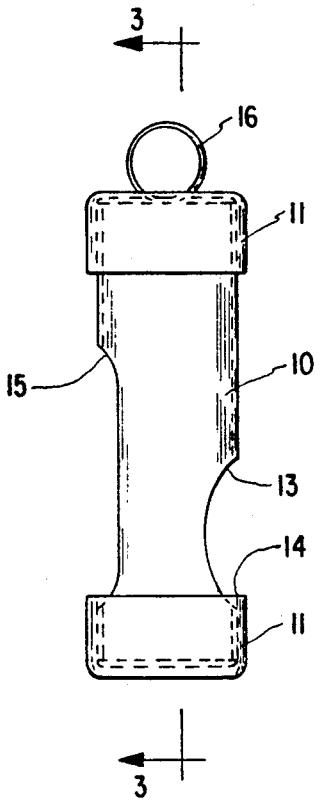
FIG. 2 is a view similar to FIG. 1 with the balls removed.
Figure 4:
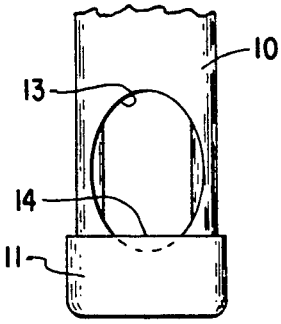
FIG. 4 is a detailed partial view of the parts surrounding the discharge opening.

Briefly my invention comprises a holder for golf balls in which the structure of the holder provides the necessary retention of the balls and yet permits ready removal of the ball when desired.

More specifically and referring to the drawings, the holder, like most others comprises a tubular body 10 having a circular cross section whose inner diameter is slightly larger than the outer diameter of a standard golf ball. The material of the tube is a thin, hard but somewhat flexible plastic material. I have determined that a thin, hard material having a wall thickness of approximately 1/32nd to 1/16th of an inch works well.

Top and bottom caps 11 are fixed at each end of the tube 10. The tube may be of a convenient length to accommodate any preferred number of balls. The figures show a tube sufficient to hold three regular golf balls, but lengths for two balls or four, five or six balls could also be used. The length of the tube, however, must be somewhat greater than the multiple of diameters of the balls, because the balls are inserted into the tube over the rim of the bottom cap 11. Therefore, the tube must accommodate the requisite number of balls plus the width of the rim.

In order to insert and eject the balls, an opening 13 is formed in the tube adjacent the lower cap 11. This opening is elliptical in shape. If the tube were flattened, the minor axis of the ellipse would be equal or preferably just slightly greater than the diameter of the golf ball. The major axis is greater than the diameter of the ball by the width of the lip 14 formed by the rim of the lower cap 11 as it overlaps the opening 13.

With this construction, when the tube is rolled into a cylinder, the minor axis of the opening 13 becomes a chord subtending the arc formed by the circumference of the cross section of the tube. This chord is somewhat smaller than the minor axis of the opening in the flattened wall, and therefore somewhat smaller than the diameter of the balls. However, by pressing the ball into the opening, the ellipse tends to distort slightly to accommodate the passage of the ball. Thus, simply by the shape and relative flexibility for the side walls and the opening 13, the ball can be releasably held within the tube with no auxiliary means needed for support.

To make removal simple, an elongated, narrow opening 15 is formed in the tube 10 opposite the ball opening 13. The slotted opening 15 is provided principally to allow the user to push the ball through the ball opening 13 using a thumb or finger. It is also usable to hold the balls in place towards the top of the tube and away from the ball opening 13 while inserting new ones through that opening.

I also prefer to use an annular pad 17 of foamed rubber or similar material to hold the lowest ball in the best position for ejection. Because of the central hole, the ball will tend to stay in the middle of the body 10, but will still be at a level for easy ejection through the opening 13.

Figure 3:
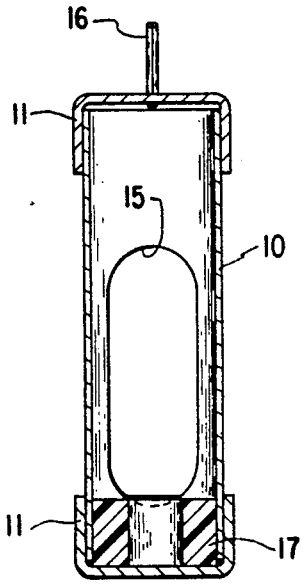
FIG. 3 is a sectional view from line 3—3 of FIG. 2.
Figure 1:
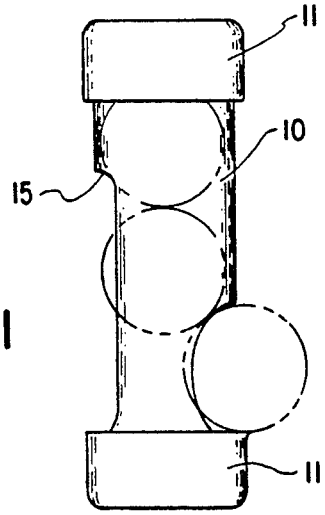
FIG. 1 is an elevational view from the side of the holder showing golf balls in place.

As shown in FIGS. 1 and 3, a ring 16 or loop or other fastening device may be provided on the upper cap 11. This ring may be used to carry the holder from a belt of the golfer, or key ring for a golf cart or other support on the person of the golfer or attachment in either the cart or the golf bag.

I claim as my invention:

1. A ball holder comprising tubular holding means including a wall forming a tube having an approximately circular cross section; closure means at both ends of said holding means to confine balls within said tubular means; said tubular means being formed with an elliptical opening having a minor axis when said wall is flat substantially equal to the diameter of the ball being held; said minor axis, when said wall is curved to form said tube, being slightly smaller than the diameter of said balls; said wall being deformable enough to allow said opening to expand in the direction of said minor axis to allow said ball to be pushed through said opening.

2. A ball holder comprising tubular holding means, caps at both ends of said holding means to confine balls within the holding means, said caps being fixed to said tubular means to hold and support said tubular means in tubular configuration, said tubular means being formed with a substantially elliptical opening near one end of said tubular means, the cap at said one end having a rim extending so as to cover a minor portion of said opening, said opening having a minor axis slightly smaller than the diameter of the balls being held, said tubular means having walls deformable enough to allow said opening to expand in the direction of said minor axis to allow said ball to be pushed through said opening.

3. The ball holder of claim 2 in which carrying means is fastened to the cap at the end opposite to said first named end.

* * * * *